US006200454B1

(12) United States Patent
Kimizuka et al.

(10) Patent No.: US 6,200,454 B1
(45) Date of Patent: Mar. 13, 2001

(54) PROCESS FOR PRODUCING SODIUM PERSULFATE

(75) Inventors: Ken-ichi Kimizuka; Shoichiro Kajiwara; Takamitsu Tsuruga, all of Kanagawa-ken (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 0 days.

(21) Appl. No.: 09/498,614

(22) Filed: Feb. 7, 2000

Related U.S. Application Data

(63) Continuation-in-part of application No. 09/204,069, filed on Dec. 3, 1998, now abandoned.

(30) Foreign Application Priority Data

Dec. 24, 1997 (JP) ..... 9-355148

(51) Int. Cl.[7] ..... C25B 1/28
(52) U.S. Cl. ..... 205/471; 205/554
(58) Field of Search ..... 205/471, 472, 205/554

(56) References Cited

U.S. PATENT DOCUMENTS

| | | | |
|---|---|---|---|
| 1,059,809 | 4/1913 | Adolph et al. | 205/471 |
| 3,791,946 | 2/1974 | Owens | 205/471 |
| 3,915,816 | 10/1975 | Rossberger | 205/471 |
| 4,144,144 | 3/1979 | Radimer et al. | 205/472 |

*Primary Examiner*—Arun S. Phasge
(74) *Attorney, Agent, or Firm*—Antonelli, Terry, Stout & Kraus, LLP

(57) ABSTRACT

There is disclosed a process for producing sodium persulfate which comprises the step (1) of electrolyzing, at an anode, a solution containing ammonium sulfate, and the step (2) of producing sodium persulfate from the resultant liquid produced at the anode and sodium hydroxide and, as desired, the step of removing sodium sulfate, and further as desired, the step (3) of performing crystallization on the reaction liquid as produced in the step (2). According to the above process, it is made possible to efficiently produce sodium persulfate having a markedly high purity substantially free from nitrogen components at a high yield at a high current efficiency in electrolysis.

14 Claims, No Drawings

PROCESS FOR PRODUCING SODIUM PERSULFATE

This application is a Continuation-in-Part application of Ser. No. 09/204,069, filed Dec. 3, 1998, the contents of which are incorporated hereby by reference in their entirety.

BACKGROUND OF THE INVENTION

The present invention relates to a process for producing sodium persulfate, which is widely employed in industrial fields at the present time as a polymerization initiator for polyvinyl chloride and polyacrylonitrile and as a treatment agent for a printed wiring board.

As a general process for producing sodium persulfate, there is known a production process by the reaction of ammonium persulfate and sodium hydroxide in an aqueous solution. It is necessary in the above-mentioned process that in the first place ammonium persulfate as a starting raw material be produced by an electrolysis method, and the resultant ammonium persulfate be concentrated and separated by vacuum crystallization, centrifugal filtration or the like and then taken out as a crystal. At this time, the solution containing the crystal (usually referred to as "mother liquor") is mixed with the liquid produced at a cathode and is used as a starting raw material for an anolyte.

The ammonium persulfate thus obtained is re-dissolved in the next step, and is transferred to the step of reaction with sodium hydroxide. In the aforesaid reaction step, a solution containing sodium persulfate is produced, then is concentrated and separated by vacuum crystallization, centrifugal filtration or the like and is subsequently taken out as a crystal. As mentioned hereinbefore, the process for producing sodium persulfate by the reaction of ammonium persulfate and sodium hydroxide necessitates quite long production steps and a number of steps, and, moreover, lowers the yield of the objective sodium persulfate based on the ammonium persulfate, thereby making itself far from economically advantageous.

Under such circumstances, several attempts have been made to produce sodium persulfate by direct electrolysis without passing through ammonium persulfate. For instance, Japanese Patent Application Laid-Open No. 56395/1975 (Sho-50) describes a process for producing sodium persulfate by the use of sodium hydrogensulfate as a starting raw material, which process, however, is impractical because of an extremely low current efficiency in the electrolysis.

In addition, Japanese Patent Publication No. 31190/1980 (Sho-55) describes a process for producing sodium persulfate by means of electrolysis through the use of a neutral starting raw material for an anolyte in the presence of ammonium ions, which process, however can not be said to be economical because of a low current efficiency being about 70 to 80% in the electrolysis. Further, the above-mentioned process suffers such disadvantages that the ammonium ions being contained in the objective crystal increase the content of nitrogen components in the objective sodium persulfate, and that the process necessitates a minute and attentive cleaning step in order to satisfy the ordinary requirement for the quality of sodium persulfate as the finished product, namely a purity of at least 99% and the content of nitrogen components of at most 0.1%. In spite of a number of efforts and endeavors having heretofore been directed towards the improvement of the production process, it is the real situation that an economical process for producing sodium persulfate has not yet been developed.

SUMMARY OF THE INVENTION

The object of the present invention is to solve the problems involved in the conventional processes for producing sodium persulfate as described hereinbefore, and at the same time to provide a process for producing sodium persulfate in an industrially advantageous manner.

As the result of intensive research and development carried out by the present inventors under such circumstances in order to overcome the aforesaid disadvantages, there has been found a process for producing sodium persulfate which comprises the steps of producing ammonium persulfate by electrolysis at an anode in the presence of sodium ions, directly adding sodium hydroxide to the resultant liquid produced at the anode to produce sodium persulfate (reaction step), and concentrating and separating the resultant sodium persulfate. It has also been found that by the use of a starting raw material for an anolyte which coexists with sodium ions and which is obtained by mixing the liquid produced at a cathode with the crystallization mother liquor formed by concentrating and separating the resultant sodium persulfate, there is obtained a current efficiency in electrolysis for ammonium persulfate which surprisingly exceeds the current efficiency for ammonium persulfate without coexisting with sodium ions. The present invention has been accomplished by the above-mentioned findings and information.

That is to say, the present invention relates to a process for producing sodium persulfate which comprises the step (1) of electrolyzing, at an anode, a solution containing ammonium sulfate and the step (2) of producing sodium persulfate from the resultant liquid produced at the anode and sodium hydroxide.

DESCRIPTION OF THE PREFERRED EMBODIMENTS

In the following, a detailed description will be given of the process according to the present invention. In the electrolysis step, that is the step (1) in the process of the present invention, there is used a solution containing ammonium sulfate as a starting raw material for an anolyte, preferably a solution containing ammonium sulfate and further containing sodium ions, in particular, a solution comprising 15 to 40% by weight of ammonium sulfate, 5 to 20% by weight of sodium sulfate and 0.1 to 20% by weight of sodium persulfate, the solution just mentioned above in the form of an aqueous solution having a concentration range in which the concentration of the ammonium sulfate is higher than that of the sodium sulfate. Preferably the starting raw material for the anolyte contains a necessary amount of a polarizer, which is exemplified by thiocyanate, cyanide, cyanate and fluoride. The starting raw material for the anolyte is not necessarily required to be regulated neutrally, and it may contain a free acid, which does not influence the current efficiency at all. There is used as a starting raw material for a catholyte, 10 to 80% by weight of an aqueous solution of sulfuric acid containing ammonium sulfate having a concentration range of 0 to 35% by weight. The use of the aqueous solution having a concentration outside the above-mentioned range is disadvantageous because of a low current efficiency obtained therefrom.

The electrolytic cell to be used for the process according to the present invention may be either a diaphragm cell which is partitioned with an alumina diaphragm and is widely industrially used, or a filter press-type electrolytic cell which is partitioned with ion exchange membranes. The anode is made preferably of platinum, and there is usable a material having chemical resistance such as a carbon electrode. The cathode is made preferably of lead or zirconium, and there is usable a metallic electrode having acid resistance such as stainless steel. The current density of the surface of the anode is at least 40 A/dm$^2$. The temperature inside an electrolytic cell is 15 to 40° C. The temperature therein, when being lower than said range, gives rise to a fear of salt deposition from the solution. The solubility of a salt increases with a rise in the temperature of the solution, but an unreasonably high temperature therein is unfavorable because of the liability of the produced persulfate to hydrolysis reaction.

The reactor to be used for the step (2) in the process according to the present invention for reacting the liquid produced at the anode with an aqueous solution of sodium hydroxide, is not specifically limited provided that it is usable under reduced pressure, and may be equipped with an agitator. The amount of sodium hydroxide to be added to the liquid produced at the anode is the amount necessary to turn all the cations contained in said liquid to sodium ions. The reaction temperature is 15 to 60° C., preferably 20 to 50° C. The reaction temperature, when being lower than said range, brings about such adverse influences as the deposition of ammonium persulfate crystal and the like, thus causing difficulty in the reaction operation and also insufficiency in the reaction. To the contrary, the reaction temperature, when being higher than said range, brings about decomposition of the persulfates and the like resulting in low yield of the objective sodium persulfate.

The reaction pressure is in the range of 10 to 400 mmHg, preferably 20 to 100 mmHg. By carrying out the reaction under such reduced pressure, it is made possible to promote the removal of ammonia gas generated in the reaction. The reaction pressure, when being lower than said range, is economically disadvantageous because of much load applied to the vacuum generating power. To the contrary, the reaction pressure, when being higher than said range, increases the solubility of the generated ammonia gas in the solution. The reaction time is preferably 30 to 60 minutes, approx. The reaction time longer than said range is economically disadvantageous. The generated ammonia gas is absorbed in the aqueous solution of sulfuric acid and recycled through the electrolysis step as a starting raw material for a catholyte.

Sodium sulfate removal operation is carried out as desired, for the purpose of removing the coexisting sodium sulfate from the reaction liquid after the completion of the reaction. The above-mentioned sodium sulfate removal operation is the operation of cooling and crystallizing the reaction liquid, and separating by precipitation the resultant crystal as sodium sulfate decahydrate. By putting the aforestated sodium sulfate removal operation into practice, it is made possible to enhance the purity of the sodium persulfate which is obtained in the next step (3) of concentration and crystallization. There is used for said operation, a tank type crystallizer equipped with a cooling apparatus, which is typified by a tank type cooling crystallizer widely used in industrial fields at the present time. The cooling crystallizing temperature is 5 to 30° C., preferably 15 to 25° C. The cooling crystallizing temperature, when being lower than said range, is unfavorable since the eutectic with sodium persulfate takes place, whereas the temperature, when being higher than said range, is also unfavorable since the precipitation of sodium sulfate is made insufficient thereby, thus lowering the purity of the objective sodium persulfate. The slurry formed after the removal of the precipitated sodium sulfate is introduced in a solid-liquid separator such as a centrifugal filter, to be subjected to solid-liquid separation. Part of the sodium sulfate in the form of crystal is re-dissolved for use as a starting raw material for an anolyte, and is recycled through the reaction system. The separated mother liquor is introduced in the next concentration and crystallization step.

As the crystallizer for subjecting the liquid, after the completion of the sodium sulfate removal, to the concentration and crystallization step {step (3)}, there is employed a tank type crystallizer which is widely and generally used. The crystallization temperature is 15 to 60° C., preferably 20 to 50° C. The crystallization temperature, when being lower than said range, is economically disadvantageous since the temperature of the condenser portion is made unreasonably low, whereas the temperature, when being higher than said range, is also unfavorable because of the decomposition of the objective sodium persulfate, thus lowering the yield thereof as is the case with the aforestated reaction. As the crystallization pressure, there is adopted a pressure at which water boils in the above-mentioned temperature range. The slurry containing the sodium persulfate after the crystallization is separated into crystal and mother liquor by the use of a solid liquid separator such as a centrifugal filter. The crystal thus obtained is dried and made into a finished product by means of a powder dryer. On the other hand, the liquid produced at the cathode by electrolysis is neutralized with sodium hydroxide, and thereafter mixed with the separated mother liquor. The resultant mixed liquid dissolves part of the sodium sulfate discharged from the sodium sulfate removal step and a necessary amount of a polarizer, and is used as a starting raw material for an anolyte. The mixing and re-dissolving tank to be used in this step is not specifically limited provided that it is equipped with an agitator, but may be selected for use from the mixing tanks that are widely used in industrial fields.

According to the process of the present invention, it is made possible to produce highly pure sodium persulfate almost free from nitrogen components, with a high current efficiency in the electrolysis.

In the following, the present invention will be described in more detail with reference to comparative examples and working examples, which however shall not limit the present invention thereto. The current efficiency in the comparative examples and working examples is represented by the formula: [persulfate ions formed (mol )×2]/[quantity of electric passage (F)]×100%, that is, the proportion of the formed sodium persulfate ions to the unit quantity of electric passage. The cell potential is the potential difference between both the electrodes. All concentrations are denoted by weight unless otherwise noted.

EXAMPLE 1

Sodium persulfate was produced through the foregoing steps (1) to (3) including electrolysis, reaction and sodium sulfate removal. The electrolytic cell used therein was made of transparent polyvinyl chloride and was constituted of an anode chamber and a cathode chamber which were partitioned with a diaphragm material made of porous neutral alumina that was fixed with a sealing agent made of silicone rubber. Each of the chambers was equipped with a buffer tank also functioning as a cooling tank. The liquid as a starting raw material was fed from the buffer tank to an electrolytic chamber with a tube pump, and the liquid in the electrolytic chamber was returned from the outlet thereof to the buffer tank by overflow. Cooling water was circulated through a glass-made tubular cooler that was inserted in the buffer tank. The anode used therein was composed of two sheets of platinum foils having a width of 1.8 cm and a length of 16 cm (area of 28.8 $cm^2$). The cathode used therein was made of a lead sheet. Both the anode and cathode were installed each about 0.5 cm away from the diaphragm. The direct current for electrolysis was supplied from a variable rectifier. The electrolysis was carried out at a current value of 44 A for 4 hours by the use of the starting raw materials each having a chemical composition as described hereunder:

Starting raw material for anolyte in the form of aqueous solution in an amount of 2970.8 g

| Item | % by weight | amount (g) |
|---|---|---|
| Sodium persulfate | 11.0 | 326.4 |
| Sodium sulfate | 12.0 | 356.0 |
| Ammonium sulfate | 18.0 | 534.4 |
| Sulfuric acid | 0.03 | 2.8 |
| Ammonium thiocyanate | 0.03 | 0.89 |

Starting raw material for catholyte in the form of aqueous solution in an amount of 1716.8 g

| Item | % by weight | amount (g) |
|---|---|---|
| Sulfuric acid | 18.8 | 322.0 |
| Ammonium sulfate | 23.5 | 404.0 |

After the electrolysis, there were obtained 2886.3 g of liquid produced at the anode and 1793.2 g of liquid produced at the cathode. The chemical compositions of the resultant liquids were analyzed by titration. The results of the analysis and the operational conditions are given hereunder:

Liquid produced at the anode

| Item | % by weight | amount (g) |
|---|---|---|
| Ammonium persulfate | 22.7 | 654.0 |
| Sodium persulfate | 11.3 | 326.4 |
| Sodium sulfate | 7.5 | 216.4 |
| Ammonium sulfate | 0.9 | 25.4 |
| Sulfuric acid | 1.1 | 31.2. |

Liquid produced at the cathode

| Item | % by weight | amount (g) |
|---|---|---|
| Sodium sulfate | 7.8 | 140.0 |
| Ammonium sulfate | 29.8 | 534.4 |
| Sulfuric acid | 0.5 | 9.6 |

Operational conditions

| | |
|---|---|
| Current efficiency | 87.3% |
| Cell potential | 7.3 V |
| Average temperature of liquid at the anode | 29° C. |
| Average temperature of liquid at the cathode | 30° C. |

The resultant liquid produced at the anode was transferred to a reactor equipped with an agitator, where the liquid was incorporated with 48% concentration of aqueous solution of sodium hydroxide in an amount of 562.8 g that is necessary to turn all of the cations contained in said liquid into sodium ions and at the same time, the ammonia gas was completely released at a vacuum of 30 mmHg and at room temperature. The reaction liquid after the ammonia gas was completely released, was subjected to cooling and crystallization at 18° C. to produce 445.2 g of sodium sulfate decahydrate by precipitating separation. The resultant sodium sulfate decahydrate was filtered off. The filtrate thus separated was transferred to a tank type crystallizer equipped with an agitator and a condenser, and was subjected to vacuum crystallization at 30° C. at a vacuum of 20 mmHg to precipitate sodium persulfate.

The slurry of sodium persulfate thus obtained was introduced into a centrifugal filter to separate the slurry into crystal and mother liquor. The crystal thus separated was completely dried to obtain 676.9 g of crystalline sodium persulfate having a purity of 99.8% with a nitrogen content of 0.001%. The yield of the sodium persulfate thus obtained was 99% based on the ammonium persulfate contained in the liquid produced at the anode.

Into a mixing re-dissolving tank were introduced 898.0 g of the mother liquor separated from the crystal; 1793.2 g of the liquid produced at the cathode that was obtained in the preceding electrolysis; and part of the sodium sulfate obtained in the preceding sodium sulfate removal step (309.6 g) to obtain a homogeneous solution. By adding a necessary amount of a polarizer to the resultant homogeneous solution there was prepared 3009.7 g of a starting raw material for the anolyte. The ammonia gas generated from the reaction step was recovered with an aqueous solution of sulfuric acid to prepare 1716.8 g of a starting raw material for the catholyte. Then electrolysis was carried out with the aforestated electrolytic cell under the same conditions as before by the use of the starting raw materials for the anolyte and catholyte thus prepared. The results were as follows:

| | |
|---|---|
| Current efficiency | 87.4% |
| Cell potential | 7.2 V |
| Average temperature of liquid at the anode | 30° C. |
| Average temperature of liquid at the cathode | 29° C. |

EXAMPLE 2

The experimental equipment such as an electrolytic cell and the like was the same as that used in Example 1. The electrolysis was carried out at a current value of 41.5 A for 6 hours using starting raw materials each having a chemical composition as described hereunder:

Starting raw material for the anolyte in the form of an aqueous solution in an amount of 2340.4 g

| Item | % by weight | amount (g) |
|---|---|---|
| Sodium persulfate | 0.2 | 5.1 |
| Sodium sulfate | 8.6 | 200.5 |
| Ammonium sulfate | 35.4 | 827.7 |
| Sulfuric acid | 0.07 | 1.6 |
| Ammonium thiocyanate | 0.03 | 0.7 |

Starting raw material for the catholyte in the form of an aqueous solution in an amount of 1554.1 g

| Item | % by weight | amount (g) |
|---|---|---|
| Sulfuric acid | 52.0 | 808.2 |

After the electrolysis, there were obtained 2218.9 g of liquid produced at the anode and 1667.7 g of liquid produced at the cathode. The chemical compositions of the resultant liquids were analyzed by titration. The results of the analysis and the operational conditions are given hereunder:

Liquid produced at the anode

| Item | % by weight | amount (g) |
|---|---|---|
| Ammonium persulfate | 39.2 | 868.7 |
| Sodium persulfate | 1.4 | 32.1 |
| Sodium sulfate | 5.6 | 125.0 |
| Ammonium sulfate | 0 | 0 |
| Sulfuric acid | 2.6 | 57.8 |

Liquid produced at the cathode

| Item | % by weight | amount (g) |
|---|---|---|
| Sodium sulfate | 3.6 | 59.4 |
| Ammonium sulfate | 19.5 | 325.3 |
| Sulfuric acid | 22.0 | 366.3 |

Operational conditions

| | |
|---|---|
| Current efficiency | 85.0% |
| Cell potential | 6.4 V |
| Average temperature of liquid at the anode | 30° C. |
| Average temperature of liquid at the cathode | 29° C. |

The resultant liquid produced at the anode was transferred to a reactor equipped with an agitator, where the liquid was incorporated with 48% concentration of aqueous solution of sodium hydroxide in an amount of 739.3 g that is necessary to turn all of the cations contained in said liquid into sodium ions and at the same time, the ammonia gas was completely released at a vacuum of 30 mmHg and at room temperature. The reaction liquid after the ammonia gas was completely released, was subjected to cooling and crystallization at 18° C. to produce 514.4 g of sodium sulfate decahydrate by precipitating separation. The resultant sodium sulfate decahydrate was filtered off. The sodium sulfate decahydrate substance contained 3% by weight of sodium persulfate. The filtrate thus separated was transferred to a tank type crystallizer equipped with an agitator and a condenser, and was subjected to vacuum crystallization at 30° C. at a vacuum of 20 mmHg to precipitate sodium persulfate.

The slurry of sodium persulfate thus obtained was introduced into a centrifugal filter to separate the slurry into crystal and mother liquor. The crystal thus separated was completely dried to obtain 915.6 g of crystalline sodium persulfate having a purity of 99.8% with a nitrogen content of 0.001%. The yield of the sodium persulfate thus obtained was 99% based on the persulfate ion contained in the liquid produced at the anode.

The ammonia gas generated by the reaction between sodium hydroxide and the liquid produced at the anode was recovered with 1667.7 g of the liquid produced at the cathode in the preceding electrolysis, and neutralized by 8.2 g of 48% concentration of aqueous sodium hydroxide solution. Part of the sodium sulfate obtained in the preceding sodium sulfate removal step (328.2 g) was dissolved in 172.4 g of pure water. The obtained solution was mixed with the preceding neutralized liquid, and then with a necessary amount of a polarizer to prepare 2340.4 g of a starting raw material for the anolyte, wherein the thus re-prepared starting raw material for the anolyte contained 0.4% by weight of sodium persulfate, 8.9% by weight of sodium sulfate, 35.3% by weight of ammonium sulfate and 0.03% by weight of ammonium thiocyanate. On the other hand, there was prepared 1554.lg of a starting raw material for the catholyte.

Then, the electrolysis was carried out with the aforestated electrolytic cell under the same conditions as before by the use of the starting raw material for the anolyte and catholyte thus re-prepared.

| The electrolysis results were as follows: | |
|---|---|
| Current efficiency | 85.2% |
| Cell potential | 6.3 V |
| Average temperature of liquid at the anode | 31° C. |
| Average temperature of liquid at the cathode | 28° C. |

EXAMPLE 3

The experimental equipment such as an electrolytic cell and the like was the same as that used in Example 1. The electrolysis was carried out at a current value of 41.5 A for 6 hours using starting raw materials each having a chemical composition as described hereunder:

Starting raw material for anolyte in the form of aqueous solution in an amount of 2588.6 g

| Item | % by weight | amount (g) |
|---|---|---|
| Sodium persulfate | 0.6 | 14.5 |
| Sodium sulfate | 13.2 | 341.7 |
| Ammonium sulfate | 26.0 | 673.0 |
| Ammonium thiocyanate | 0.03 | 0.8 |

Starting raw material for catholyte in the form of aqueous solution in an amount of 1649.8 g

| Item | % by weight | amount (g) |
|---|---|---|
| Sulfuric acid | 43.8 | 723.0 |

After the electrolysis, there were obtained 2269.8 g of liquid produced at the anode and 1960.9 g of liquid produced at the cathode. The chemical compositions of the resultant liquids were analyzed by titration. The results of the analysis and the operational conditions are given hereunder:

Liquid produced at the anode

| Item | % by weight | amount (g) |
|---|---|---|
| Ammonium persulfate | 28.3 | 642.9 |
| Sodium persulfate | 10.8 | 245.5 |
| Sodium sulfate | 4.0 | 91.5 |
| Ammonium sulfate | 0 | 0 |
| Sulfuric acid | 3.0 | 67.4 |

Liquid produced at the cathode

| Item | % by weight | amount (g) |
|---|---|---|
| Sodium sulfate | 5.7 | 112.4 |
| Ammonium sulfate | 15.4 | 301.5 |
| Sulfuric acid | 14.5 | 284.6 |

Operational conditions

| | |
|---|---|
| Current efficiency | 82.0% |
| Cell potential | 6.4 V |
| Average temperature of liquid at the anode | 30° C. |
| Average temperature of liquid at the cathode | 29° C. |

2269.8 g of the resultant liquid produced at the anode and 5233.5 g of the mother liquor obtained in the later mentioned sodium sulfate removal step were mixed and transferred into a distillation equipment equipped with an agitator and a condenser, wherein the mother liquor of sodium sulfate removal step contained 37.9% by weight of sodium persulfate and 4.9% by weight of sodium sulfate. 670.4 g of water was distilled at an inner pressure of 72 mmHg and at a temperature of 45° C.

A crystallization tank for the reaction between the anode-liquid in the above mixed solution and sodium hydroxide and for the precipitation of sodium persulfate was equipped with an agitator and a condenser. And the crystallization tank had been charged with a slurry (444.4 g of crystalline sodium persulfate and 2852.0 g of crystallization mother liquor) prepared in the electrolysis step, the crystallization step and the sodium sulfate removal step.

6832.9 g of the concentrated liquor obtained in the preceding distillation operation was fed into the crystallization tank containing the above slurry at a velocity of 1138.8 g/hr. At the same time, 48% concentration of aqueous solution hydroxide solution was fed into the crystallization tank at a velocity of 100.6 g/hr.

The crystallization tank was maintained at 30° C. and at 20 mmHg, wherein water was removed at a velocity of 123.1 g/hr and completely condensed in the condenser. The ammonia gas generated from the reaction between ammonium persulfate and sodium hydroxide was not condensed in the condenser, and was released from the exhaust of a dry pump used as a vacuum generation equipment. The exhaust of the dry pump was equipped with an ammonia trap containing 1960.9 g of liquid produced at the cathode to absorb the released ammonia gas.

The removal of the slurry was carried out to keep the liquid surface of the crystallization tank constant. The removal velocity of the slurry was 1098.8 g/hr. The obtained slurry was filtered in a centrifugal filter to separate the slurry into crystalline sodium persulfate and mother liquor. The separation velocity of the crystalline sodium persulfate was 148.1 g/hr (as dry basis) and the separation velocity of the mother liquor was 950.7 g/hr.

The separated mother liquor was introduced into a cooling-crystallization tank equipped with an agitator and a cooling tube to precipitate sodium sulfate hydrate corresponding to sodium sulfate decahydrate, wherein the precipitation velocity was 78.4 g/hr. The separation velocity of crystal and the separated mother liquor was 872.2 g/hr.

The above crystallization step and sodium sulfate removal step were carried out for 6 hours to obtain 888.8 g (as dry basis) of crystalline sodium persulfate, 470.4 g of sodium sulfate decahydrate and 5233.5 g of the mother liquor of the sodium sulfate removal step. Further, there was obtained 2087.0 g of the liquid absorbing the ammonia gas generated from the crystallization tank. Crystalline sodium persulfate had a purity of 99.9% with a nitrogen content of 0.001%. The yield of the sodium persulfate was 99% based on persulfate ion produced in the electrolysis. The sodium sulfate decahydrate substance contained circa 3% by weight of sodium persulfate.

The liquid absorbing ammonia gas, which was analyzed by titration, contained 5.4% by weight of sodium sulfate, 32.2% by weight of ammonium sulfate and 0.9% by weight of sulfuric acid, wherein the recovery percentage of ammonia was 98%.

The sulfuric acid in the liquid absorbing ammonia gas was neutralized by 0.5 g of ammonia gas and 29.0 g of 48% concentration of aqueous sodium hydroxide solution. Into 2116.6 g of the neutralized liquid, 470.4 g of sodium sulfate decahydrate obtained in the preceding sodium sulfate removal step was dissolved, and then 1.6 g of 50% concentration of aqueous ammonium thiocyanate solution was added.

By the use of 2588.6 g of the obtained liquid as the starting raw material for the anolyte, the electrolysis was carried out with the aforestated electrolytic cell under the same conditions as before, wherein the re-prepared starting raw material for the anolyte was an aqueous liquid containing 0.5% by weight of sodium persulfate, 13.1% by weight of sodium sulfate, 26.0% by weight of ammonium sulfate and 0.03% by weight of ammonium thiocyanate. On the other hand, 1649.8 g of 43.8% concentration of aqueous sulfuric acid solution was prepared as the starting raw materials for the catholyte.

The electrolysis results were as follows:

| | |
|---|---|
| Current efficiency | 82.2% |
| Cell potential | 6.3 V |
| Average temperature of liquid at the anode | 30° C. |
| Average temperature of liquid at the cathode | 29° C. |

COMPARATIVE EXAMPLE 1

A trial was made to produce sodium persulfate by direct electrolysis in the coexistence of ammonium ions in accordance with the method as described in Japanese Patent Publication No. 31190/1980(Sho-55), by the use of the experimental equipment such as an electrolytic cell same as that used in Example 1. The electrolysis was carried out at a current value of 44 A for 2.5 hours by the use of the starting raw materials each having a chemical composition as described hereunder:

Starting raw material for anolyte in the form of aqueous solution in an amount of 3450 g

| Item | % by weight | amount (g) |
|---|---|---|
| Sodium persulfate | 20.5 | 707.3 |
| Sodium sulfate | 12.1 | 417.5 |
| Ammonium sulfate | 9.81 | 338.4 |
| Sulfuric acid | 0 | 0 |
| Ammonium thiocyanate | 0.03 | 1.04 |

Starting raw material for catholyte in the form of aqueous solution in an amount of 950 g

| Item | % by weight | amount (g) |
|---|---|---|
| Sulfuric acid | 29.7 | 282.2 |

After the electrolysis, there were obtained 3300 g of liquid produced at the anode and 1000 g of liquid produced at the cathode. The chemical compositions of the resultant liquids were analyzed by titration. The results of the analysis and the operational conditions are given hereunder:

Liquid produced at the anode

| Item | % by weight | amount (g) |
|---|---|---|
| Sodium persulfate | 34.5 | 1138.0 |
| Sodium sulfate | 0.5 | 16.5 |
| Ammonium sulfate | 8.1 | 267.3 |
| Sulfuric acid | 1.1 | 36.3. |

Liquid produced at the cathode

| Item | % by weight | amount (g) |
|---|---|---|
| Sodium sulfate | 12.6 | 126.0 |
| Ammonium sulfate | 6.78 | 67.8 |
| Sulfuric acid | 6.2 | 62.0 |

Operational conditions

| | |
|---|---|
| Current efficiency | 80.3% |
| Cell potential | 7.9 V |
| Average temperature of liquid at the anode | 33° C. |
| Average temperature of liquid at the cathode | 38° C. |

By the use of a reactor the same as that used in Example 1, the liquid produced at the anode was incorporated with 48% concentration of aqueous solution of sodium hydroxide in an amount necessary to neutralize the sulfuric acid contained in the liquid produced at the anode that had been obtained by the electrolysis. The resultant neutralized liquid was subjected to vacuum crystallization at 30° C. at a vacuum of 20 mmHg to precipitate sodium persulfate.

The slurry of sodium persulfate thus obtained was introduced into a centrifugal filter to separate the slurry into crystal and mother liquor. The crystal thus obtained was completely dried to produce 450 g of crystalline sodium persulfate having a purity of 98.0% with a nitrogen content of 0.2%.

The results of the direct electrolysis process revealed a current efficiency of about 80%, and a low purity of the crystal obtained by crystallization. Moreover, in order to obtain the crystal having a purity as high as that in Example 1, it was required to carry out minute and attentive cleaning by using a saturated solution of sodium persulfate which had been made slightly alkaline with sodium hydroxide. In addition, the final yield of the objective sodium persulfate produced by electrolysis was 95%, which was lowered by the cleaning.

COMPARATIVE EXAMPLE 2

A trial was made to produce sodium persulfate through the general conventional process by reacting ammonium persulfate and sodium hydroxide. This process is equivalent to the process for producing sodium persulfate by electrolysis in the non-coexistence of sodium ions. The electrolysis was carried out at a current value of 44 A for 3 hours by the use of the starting raw materials each having a chemical composition as described hereunder:

Starting raw material for anolyte in the form of aqueous solution in an amount of 2300 g

| Item | % by weight | amount (g) |
|---|---|---|
| Ammonium persulfate | 7.2 | 165.6 |
| Ammonium sulfate | 33.6 | 772.8 |
| Sulfuric acid | 5.8 | 133.4 |
| Ammonium thiocyanate | 0.03 | 0.69 |

Starting raw material for catholyte in the form of aqueous solution in an amount of 1950 g

| Item | % by weight | amount (g) |
|---|---|---|
| Sulfuric acid | 14.4 | 280.8 |

After the electrolysis, there were obtained 2600 g of liquid produced at the anode and 1600 g of liquid produced at the cathode. The chemical compositions of the resultant liquids were analyzed by titration. The results of the analysis and the operational conditions are given hereunder:

Liquid produced at the anode

| Item | % by weight | amount (g) |
|---|---|---|
| Ammonium persulfate | 24.3 | 631.8 |
| Ammonium sulfate | 10.8 | 280.8 |
| Sulfuric acid | 6.5 | 169.0. |

Liquid produced at the cathode

| Item | % by weight | amount (g) |
|---|---|---|
| Ammonium sulfate | 8.4 | 134.4 |
| Sulfuric acid | 3.4 | 54.4 |

Operational conditions

| | |
|---|---|
| Current efficiency | 81.8% |
| Cell potential | 7.8 V |
| Average temperature of liquid at the anode | 32° C. |
| Average temperature of liquid at the cathode | 34° C. |

The liquid produced at the anode thus obtained was subjected to vacuum crystallization at 30° C. at a vacuum of 20 mmHg to precipitate ammonium persulfate. The slurry of ammonium persulfate thus obtained was introduced into a centrifugal filter to separate the slurry into crystal and mother liquor. The resultant hydrous crystal was re-dissolved and was incorporated with 48% concentration of aqueous solution of sodium hydroxide to proceed with the reaction. From the solution, crystalline sodium persulfate was separated and recovered, and then was completely dried. As a result, there was obtained 445 g of crystalline sodium persulfate having a purity of 99.5% with a nitrogen content of 0.001% at a yield of 95%. In conclusion, the current efficiency was lower than that in the process according to the present invention by about 6% (87.4–81.8), and further, the yield of the objective sodium persulfate produced by electrolysis on the basis of the ammonium persulfate was lower than that in the process according to the present invention by about 4% (99–95).

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

What is claimed is:

1. A process for producing sodium persulfate, which comprises the step (1) of electrolyzing, at an anode, a solution containing ammonium sulfate, and the step (2) of producing sodium persulfate from the resultant liquid produced at the anode and sodium hydroxide, wherein the step (1) is carried out by using, as a starting raw material for an anolyte, an aqueous solution comprising 15 to 40% by weight of ammonium sulfate, 5 to 20% by weight of sodium sulfate and 0.1 to 20% by weight of sodium persulfate, and the concentration of the ammonium sulfate is higher than that of the sodium sulfate.

2. The process for producing sodium persulfate according to claim 1, which further comprises the step (3) of performing crystallization on a reaction liquid as produced in the step (2), after the step (2).

3. The process for producing sodium persulfate according to claim 2, which further comprises the step of carrying out sodium sulfate removal, after the step (3) of performing crystallization on the reaction liquid.

4. The process for producing sodium persulfate according to claim 3, wherein the step (1) is carried out by using, as the starting raw material for the anolyte, a liquid produced at a cathode in the electrolyzing, sodium hydroxide, ammonia and sodium sulfate produced in the sodium sulfate removal operation.

5. The process for producing sodium persulfate according to claim 2, which further comprises the step of carrying out sodium sulfate removal, after the step (2) and before the step (3) of performing crystallization on the reaction liquid.

6. The process for producing sodium persulfate according to claim 5, wherein the step (1) is carried out by using, as the starting raw material for the anolyte, a liquid produced at a cathode in the electrolyzing, sodium hydroxide, sodium sulfate produced in the sodium sulfate removal operation and mother liquor of the step (3) of performing crystallization on the reaction liquid as produced in the step (2).

7. The process for producing sodium persulfate according to claim 1, wherein the anode in the step (1) is constituted of platinum.

8. The process for producing sodium persulfate according to claim 1, wherein the step (1) is carried out at a current density of the surface of the anode of at least 40 $A/dm^2$.

9. The process for producing sodium persulfate according to claim 1, wherein the step (1) is carried out at a temperature in the range of 150 to 40° C.

10. The process for producing sodium persulfate according to claim 1, wherein the step (2) is carried out at a temperature in the range of 150 to 60° C.

11. The process for producing sodium persulfate according to claim 1, wherein the step (2) is carried out at a pressure in the range of 10 to 400 mmHg.

12. The process for producing sodium persulfate according to claim 1, wherein the starting raw material for the anolyte further includes a polarizer.

13. The process for producing sodium persulfate according to claim 1, wherein said electrolyzing is performed by using, as a starting raw material for a catholyte, 10–80% by weight of an aqueous solution of sulfuric acid containing ammonium sulfate having a concentration range of 0–35% by weight.

14. A process for producing sodium persulfate, which comprises the step (1) of electrolyzing, at an anode, a solution containing ammonium sulfate, and the step (2) of producing sodium persulfate from the resultant liquid produced at the anode and sodium hydroxide, wherein the step (1) is carried out by using, as a starting raw material for an anolyte, an aqueous solution including ammonium sulfate and sodium sulfate, and the concentration of the ammonium sulfate is higher than that of the sodium sulfate.

* * * * *